US006340290B1

(12) United States Patent
Schott et al.

(10) Patent No.: US 6,340,290 B1
(45) Date of Patent: Jan. 22, 2002

(54) CONTROLLABLE PITCH PROPELLER WITH A FAIL SAFE INCREASED PITCH MOVEMENT

(75) Inventors: Carl G. Schott, Fond du Lac; Roger E. Koepsel, Oshkosh, both of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/597,521

(22) Filed: Jun. 20, 2000

(51) Int. Cl.[7] ..... B63H 1/06
(52) U.S. Cl. ..... 416/157 R; 416/158; 416/223 R
(58) Field of Search ..... 416/155, 156, 416/157 R, 157 A, 158, 93 A, 223 R; 440/40, 50

(56) References Cited

U.S. PATENT DOCUMENTS

| | | | | |
|---|---|---|---|---|
| 3,794,441 A | | 2/1974 | Johnson | 416/152 |
| 3,801,219 A | | 4/1974 | Parsons et al. | 416/157 |
| 3,972,646 A | | 8/1976 | Brown et al. | 416/228 |
| 4,304,524 A | | 12/1981 | Coxon | 416/131 |
| 4,792,279 A | | 12/1988 | Bergeron | 416/89 |
| 4,897,056 A | | 1/1990 | Muller | 440/50 |
| 5,290,147 A | * | 3/1994 | Karls et al. | 416/34 |
| 5,326,223 A | | 7/1994 | Speer | 416/46 |
| 5,368,442 A | | 11/1994 | Speer | 416/167 |
| 5,967,750 A | | 10/1999 | Elliott | 416/61 |
| 5,997,253 A | | 12/1999 | Feehan | 416/207 |
| 6,261,062 B1 | * | 7/2001 | Amerling et al. | 416/147 |

* cited by examiner

*Primary Examiner*—Edward K. Look
*Assistant Examiner*—Ninh Nguyen
(74) *Attorney, Agent, or Firm*—William D. Lanyi

(57) ABSTRACT

A controllable pitch propeller is provided with a blade that naturally tends to rotate in a direction toward maximum pitch as a result of the hydrodynamic forces on the blade. As a result, the blade will move toward a pitch position of increased pitch magnitude in the event that a control system failure occurs. If the blades of a propeller move naturally toward their maximum pitch position in the event of a hydraulic, mechanical, or electrical failure in the pitch control system, the propeller will be operable and will allow a marine vessel operator to navigate toward port even with a propeller pitch control system that has malfunctioned.

20 Claims, 4 Drawing Sheets

CONTROLLABLE PITCH PROPELLER WITH A FAIL SAFE INCREASED PITCH MOVEMENT

BACKGROUND OF THE INVENTION

1. Field of the Invention

The present invention is generally related to controllable pitch propellers and, more specifically, to a controllable pitch propeller that automatically changes the pitch of the propeller blades to an increased pitch position in the event that the propeller blade actuator fails, such as because of a mechanical fracture or the failure of a hydraulic actuation system.

2. Description of the Prior Art

Four basic types of marine propellers are known to those skilled in the art. Some propellers have blades that are integral with the propeller hub and which are disposed at fixed pitch positions relative to the propeller hub. Other propellers allow the pitch of the propeller blades to be adjusted manually by manually detaching the blades from the propeller hub and then manually reattaching the blades to the propeller hub at a desired pitch position. Some propellers are configured to automatically change their pitch in response to hydrodynamic and/or centrifugal forces during operation of the propeller. Other propellers, which are referred to herein as controllable variable pitch propellers, are controlled through the use of mechanical or hydraulic systems so that the pitch of the blade can be changed under the command of a remote controller, such as a microprocessor.

Various types of controllable pitch propellers are known to those skilled in the art. An external controller can provide signals to a hydraulic, mechanical, or electrical actuation system in order to selectively change the pitch of the propeller blades during operation. Typically, the controller senses various parameters relating to an engine of a marine vessel and speed of the vessel to determine a desirable pitch setting for the blades of a propeller. Commands are then provided to the actuation system which physically moves the propeller blades relative to the propeller hub to achieve the desired pitch angle.

U.S. Pat. No. 3,801,219, which issued to Parsons et al on Apr. 2, 1974, describes a controllable pitch marine propeller. It comprises a hub which has a one piece casting mounting the blade spindles, irreversible pitch controll mechanism, and a rotary motor control and gear reducer. Although low in weight and small in overall size, precise control over blade angles is maintained and wear is minimized.

U.S. Pat. No. 4,897,056, which issued to Muller on Jan. 30, 1990, describes a propeller for a water vehicle. The variable pitch propeller is fixed to a guide body pivotable about an axis and can be raised above the water surface by its pivoting about the axis. An adjusting device jointly rotating with the hub of the variable pitch propeller and positioned on that hub can be set or adjusted without difficulty by a rotatable handle to adjust the pitch of the propeller blades in accordance with the intended travel mode, whereby a detectable fuel saving can be achieved.

U.S. Pat. No. 5,967,750, which issued to Elliott on Oct. 19, 1999, describes a variable pitch marine propeller. The propeller system has a propeller unit for mounting on a driveshaft, and a power unit including a stationary annular hydraulic cylinder for operating the propeller unit, a hydraulic remote control unit being fluid coupled to the power unit. An annular piston of the hydraulic cylinder is coupled to a ring-shaped actuator yoke by a roller thrust bearing, the actuator yoke axially displacing a mating yoke of the propeller unit with which the actuator yoke is allowed to rotate. The piston operates in a sealed environment for exclusion of water from the separately sealed surfaces of the cylinder itself. In one configuration, the propeller unit is displaced without disturbing the sealed environment of the annular piston. The control includes a hydraulic controlled cylinder that is operated by a rotatably mounted barrel that engages a threaded piston rod. Alternatively, the control cylinder is actuated by a lever having biasing springs and an adjustable brake.

U.S. Pat. No. 3,794,441, which issued to Johnson on Feb. 26, 1974, describes a variable pitch propeller. It particularly pertains to a means whereby the blade pitch in a propeller may be varied by employing unidirectional rotation of a propeller shaft, a portion of the power driving the propeller, and a pair of braking means. A propeller hub having a plurality of pivotally mounted blades is mounted on the propeller shaft. A blade pitch actuator member having a hub end and a brake end extends through the propeller shaft into the propeller hub. An eccentric slider block secured to the hub end of the actuator member is interconnected to each of the propeller blades. An actuator gear is screw mounted on the brake end of the actuator member. Three pairs of planetary pinions, each pair secured to a common shaft, are mounted on the propeller shaft in substantially parallel spaced relation to the axis of rotation of the propeller shaft. One of each pair of planetary pinions is meshed with the actuator gear and further meshed with an outer sun gear secured to a first brake actuated member. The other of each pair of planetary pinions is meshed with an inner sun gear secured to a secondary brake actuated member. Each brake actuated member has a brake actuator means. Application of the first brake means causes the actuator gear to rotate in one direction and application of the second brake means causes the actuator gear to rotate in the other direction. Rotation of the screw mounted actuator causes movement of the actuator member and eccentric slider block, thus altering the propeller blade pitch.

U.S. Pat. No. 3,972,646, which issued to Brown et al on Aug. 3, 1976, describes a propeller blade structure and method particularly adapted for marine ducted reversible thrusters and the like for minimizing cavitation and related noise. The blade design is concerned with reducing blade generated cavitation and accompanying noise in systems such as marine ducted reversible thrusters and the like, by novel techniques including a skew-forward blade configuration at the outer radii and particular blade thickness/chord length ratios associated therewith.

U.S. Pat. No. 5,997,253, which issued to Feehan on Dec. 7, 1999, discloses an adjustable pitch propeller which is provided with a receptacle on its hub which is shaped to receive a base portion of a propeller blade. First and second pluralities of alignment devices are provided to allow an operator to select a desired pitch angle and attach the blades of the propeller to the hub so that the desired pitch angle is selected. Alignment devices can comprise a plurality of holes in each receptacle which are tapped to receive a bolt in threaded association therein. Associated holes in the base portion of the propeller can allow free passage of the bolt by selecting one of the holes in the base portion of the propeller and aligning that hole with an associated hole in the receptacle of the hub. An operator can quickly and easily select a desired pitch angle for the blade. A bolt passes through a hole in the base portion of the blade and threads into the associated hole in the propeller hub to select the pitch and attach the base portion to the hub.

U.S. Pat. No. 4,792,279, which issued to Bergeron on Dec. 20, 1988, describes a variable pitch propeller. The automatic variable pitch propeller comprises a central hub defining an axis of propeller rotation and a plurality of blades connected to and extending from the central hub substantially normal to the axis of rotation. Each blade is mounted for rotation about a pitch axis. Means is provided to translate outward movement of that blade resulting from centrifugal forces imposed on that blade by rotation of the propeller into a force tending to rotate that blade about its pitch axis toward a feathered pitch condition. The force is opposed by a feathering force acting at a center pressure of the blade offset from the pitch axis. It is caused by resistance to rotation of the propeller and tends to decrease blade pitch toward a feathered condition.

U.S. Pat. No. 5,326,223, which issued to Speer on Jul. 5, 1994, describes an automatic variable pitch marine propeller with mechanical holding means. The self-actuating variable pitch marine propeller incorporates two or more blades, each independently rotatable, relative to the propeller hub and between a first lower and a second higher pitch. The blades are preferably mechanically linked by coordinating devices and are caused to move preferably by a combination of centrifugal force effect resulting from inertial masses and the hydrodynamic forces acting upon the blade. The rotation of the blades relative to the propeller hub is restrained until the restrait is overcome by the forces acting to pivot the blades to the higher pitch position. Most preferably, there is also provided a mechanical bias such as a spring to hold the blades in the lower pitch position. Initially, the hydrodynamic forces can also tend to hold the blades in the lower pitch position or to move the blades toward the higher pitch position.

U.S. Pat. No. 5,368,442, which issued to Speer on Nov. 29, 1994, describes an automatic variable discrete pitch marine propeller. The propeller incorporates two or more blades that are rotatably connected to a central hub. The blades rotate relative to the hub center about the shank axis. In operation, the blades are biased toward the lower pitch, both by mechanical means such as a spring and optionally also by hydrodynamic load means. As the propeller rotational speed increases, centrifugal forces act to move the blades towards the higher pitch position. In one mode, the hydrodynamic load also acts toward the higher pitch position. There is further provided a holding mechanism to retain or hold the blades at least preferably in the lower pitch position. The mechanism is designed to sharply define combinations of parameters, including rotation speed and optimally hydrodynamic load acting on the blades. The holding mechanism is caused to be released and the blades are permitted to move to a second higher pitch position.

U.S. Pat. No. 4,304,524, which issued to Coxon on Dec. 8, 1981, describes a marine propeller. A variable pitch marine propeller is described which comprises helicoidal blades each mounted on a hub to freely pivot about a radial axis spaced in front, in the direction of rotation, of the center of pressure of the blade whereby water pressure acting on the blade exerts a torque which tends to turn it about its axis in a direction to bring the surfaces of the blade in line with the flow of water over it. The axis is also spaced behind, with respect to the direction of the movement of the propeller through the water, a major portion of the pressure surface of the blade whereby the resultant of the drag of the water exerts a torque which tends to turn the blade in an opposite direction. The shape and mass distribution of the blades relative to their pivot axis are also such that centrifugal effects tend to move the blades, in the absence of hydrodynamic forces, into a pitch equal to that of the helicoid. In operation, each blade adopts a stable equilibrium position in which its pitch is optimally suited to the speed of rotation and the linear axial speed of the propeller.

In self adjusting blades, in which centrifugal force and hydrodynamic forces change the pitch angle of the blades, it is common to selectively design the blades in such a way that hydrodynamic forces tend to move the blades toward a higher or lower pitch position, depending on the application. However, it should be clearly understood that self adjusting blades are not intended or required to move in response to an actuator that is either mechanically, electrically, or hydraulically driven and controlled by a remote controller. Therefore, it is typical to utilize hydrodynamic forces on the blades to move the blades toward a higher pitch position so that higher rotational speeds of the propeller will create higher pitch angles of the blades and therefore improve the economy of operation of the self adjusting blades. However, in controllable pitch propellers that utilize a remotely controlled actuator to move the blades into desired pitch positions in response to signals from a remote controller, it is not common to design the blades so that hydrodynamic forces cause the blades to move toward a position of higher pitch.

It is possible that the actuation system of a controllable pitch propeller may fail. In the event of a failure in the actuation system, it would be significantly beneficial if the blades could be automatically moved to a higher pitch position in order to allow the operator of a marine vessel to return safely to home port or to a place where the failed actuation system can be repaired.

SUMMARY OF THE INVENTION

A controllable pitch propeller made in accordance with the present invention comprises a hub structure attachable to a propeller shaft of a marine propulsion system of a marine vessel for rotation about an axis of the propeller shaft. A first blade is rotatably attached to the hub structure for rotation about a spindle axis. The first blade has a surface which is shaped to create a force having a component generally parallel to the axis of the propeller shaft in response to rotation of the hub structure with said first blade being at least partially submerged in water. The first blade is rotatable about the spindle axis. The surface of the first blade has an effective center of pressure located within a zone of pressure centers and at an instantaneous position within the zone of pressure centers which is determined as a function of both a speed of the marine vessel and a rotational speed of the hub structure about the axis of the propeller shaft. The force has a magnitude determined as a function of both the speed of the marine vessel and the rotational speed of the hub structure about the axis of the propeller shaft. The force acts on the surface of the first blade at the instantaneous position of the center of pressure within the zone of pressure centers. The first blade is shaped to result in the zone of pressure centers being ahead of the spindle axis relative to the direction of rotation of the hub structure under at least a majority of the magnitudes of the speed of the marine vessel and the rotational speed of the hub structure about the axis of the propeller shaft under which the propeller is operated.

The propeller further comprises a controller for selecting a desired pitch of the first blade. It also comprises an actuator disposed within the hub structure to cause the first blade to rotate about the spindle axis in response to control signals from the controller that are selected to achieve the desired pitch of the first blade. The first blade is moved toward a position of higher pitch in response to hydrodynamic forces on the surface of the first blade under at least the majority of operating conditions in the event that the actuator is rendered ineffective to control the pitch of the first blade.

In a particularly preferred embodiment of the present invention, a second blade and a third blade are shaped, disposed, and configured similarly to the first blade. In a preferred embodiment of the present invention, the first blade is shaped to result in the spindle axis being ahead of the zone of pressure centers relative to the direction of rotation of the hub structure under all operating conditions. The propeller can further comprise a hydraulic system comprising at least one piston disposed in a cylinder for moving said actuator. Alternatively, it can comprise a mechanical device connected in force transmitting association with the actuator for urging the first blade toward a position of higher pitch independently of any hydrodynamic forces on the surface of the first blade.

The instantaneous position within the zone of pressure centers is determined as a direct function of the speed of the marine vessel and as an inverse function of the rotational speed of the hub structure about the axis of the propeller shaft. Furthermore, the force can have a magnitude determined as an inverse function of the speed of the marine vessel at constant rotational speed and as a direct function of the square of the rotational speed of the hub structure about the axis of the propeller shaft.

The actuator can comprise a rack and pinion structure and the first blade can be shaped to result in the spindle axis being ahead of the zone of pressure centers relative to the direction of rotation of the hub structure when the hub is rotating in a direction to cause the force to propel the marine vessel to move in a forward direction.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
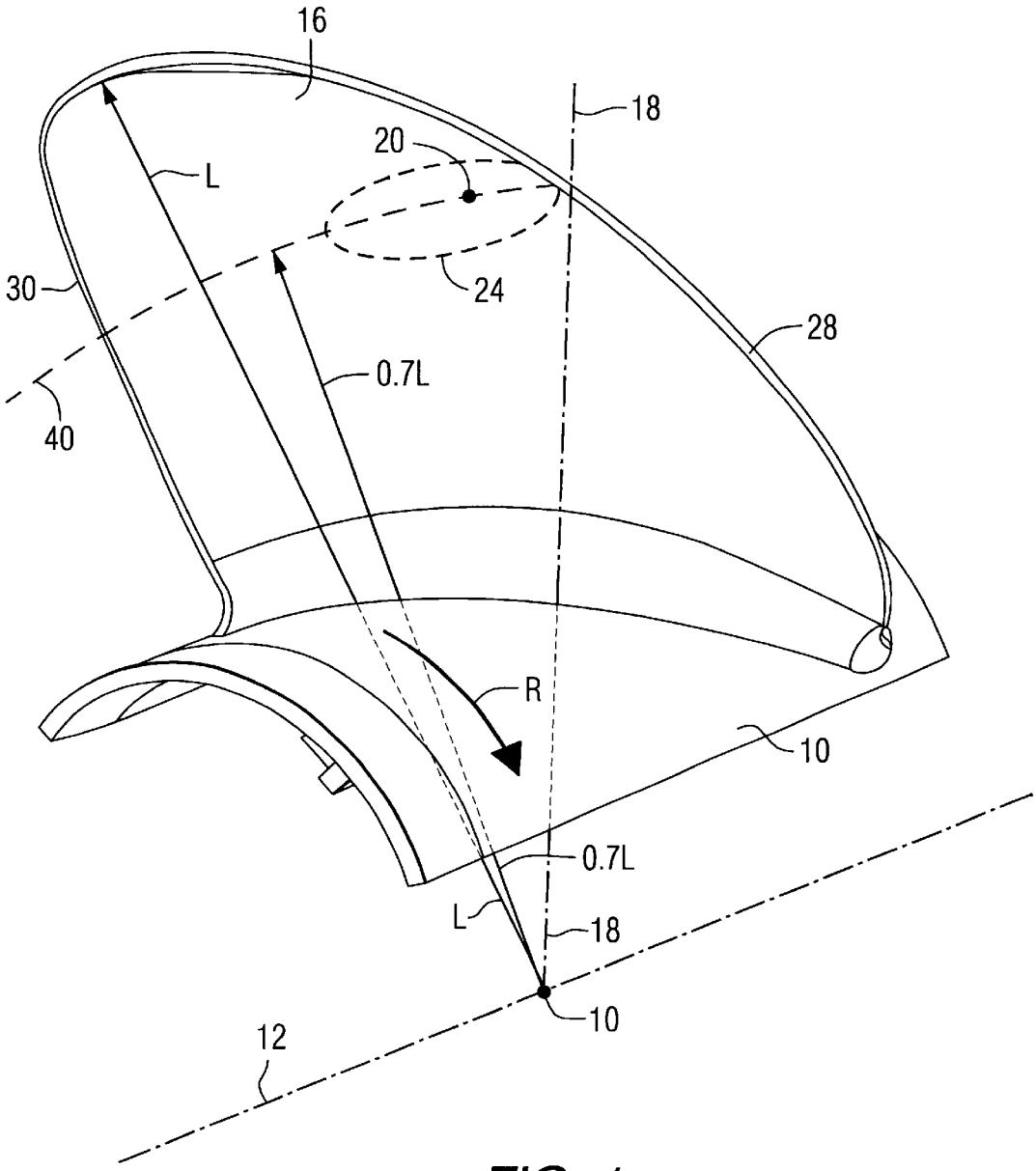
FIG. 1 PRIOR ART
FIG. 1 is schematic representation of a known propeller blade.

Throughout the description of the preferred embodiment of the present invention, like components will be identified by like reference numerals.

FIG. 1 is an illustration of a section of a known propeller and blade configuration. A hub structure 10 is rotatable about an axis 12 of a propeller shaft. A first blade 16 is rotatably attached to the hub structure 10 for rotation about a spindle axis 18. The first blade 16 has a surface which is shaped to create a force having a component generally parallel to the axis 12 of the propeller shaft in response to rotation of the hub structure 10 with the first blade 16 at least partially submerged in water. The first blade 16 is rotatable about the spindle axis 18. The surface of the first blade 16 has an effective center of pressure 20 that is located within a zone 24 of pressure centers and is located at an instantaneous position, within the zone of pressure centers, identified by reference numeral 20 in FIG. 1. The instantaneous position of the effective center of pressure within the zone of pressure centers is determined as a function of both the speed of the marine vessel, relative to the water in which the vessel operates, and a rotational speed of the hub structure 10 about the axis 12 of the propeller shaft.

The force at the center of pressure 20 has a magnitude that is determined as a function of both the speed of the marine vessel and the rotational speed of the hub structure about the axis of the propeller shaft 12. The force acting on the surface of the first blade 16 at the instantaneous position of the center of pressure 20 within the zone 24 of pressure centers has a component that is generally parallel to the axis 12 and provides the thrust which propels the marine vessel.

With continued reference to the prior art configuration shown in FIG. 1, the first blade 16 has a leading edge 28 and a trailing edge 30. The effective center of pressure 20 typically occurs within a zone 24 of pressure centers that is located in the general region of a line 40 drawn at a distance that is approximately equal to 70% of the length from the axis 12 to the blade tip 44. This length is identified as L in FIG. 1. The 70% line is identified by radial arrow 0.7 L in FIG. 1.

Figure 2:
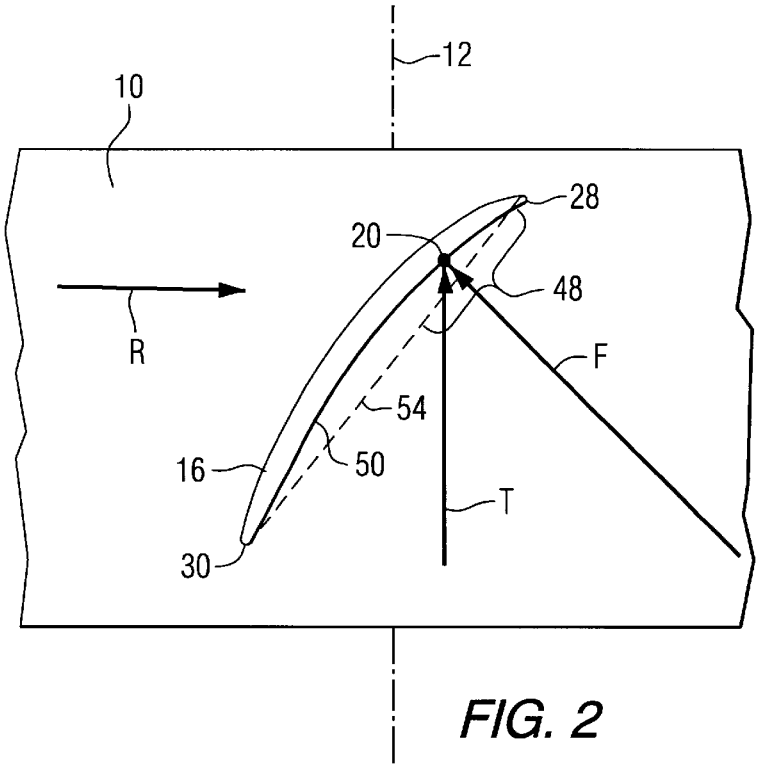
FIG. 2 is an alternative view of a blade and a hub.

With reference to FIGS. 1 and 2, the zone 24 of pressure centers typically falls along dashed line 40 within a region that is approximately 30% to 60% of the distance from the leading edge 24 to the trailing edge 30. This region is identified by reference numeral 48 in FIG. 2. The force on the surface 50 of the first blade 16 can be considered to be acting at the center of pressure 20. This force F has a component of thrust T that is generally parallel to the axis 12 of the propeller shaft. The distance represented by reference numeral 48 in FIG. 2 is approximately 25% of the chordal length 54 shown in FIG. 2.

With reference to FIGS. 1 and 2, it is generally known to those skilled in the art that the center of pressure 20 can vary within the zone 24 of pressure centers and typically moves closer to the leading edge 28 under conditions of high acceleration and moves closer to the trailing edge 30, but within the zone 24, under cruise conditions. Therefore, the specific instantaneous position of the center of pressure 20 within the zone 24 will vary as the rotational speed of the hub structure 10 and the velocity of the marine vessel change. It is also generally known to those skilled in the art that the magnitude of the force F will vary directly with the square of the rotational speed (RPM) of the hub structure 10 and inversely with respect to the velocity of the marine vessel. Furthermore, it is generally known to those skilled in the art that the specific instantaneous position of the center of pressure 20 will vary with the flow angle of attack of the water relative to the blade 16 which, in turn, varies directly with respect to the velocity of the marine vessel and indirectly with respect to the rotational speed of the hub structure 10.

Figure 3:
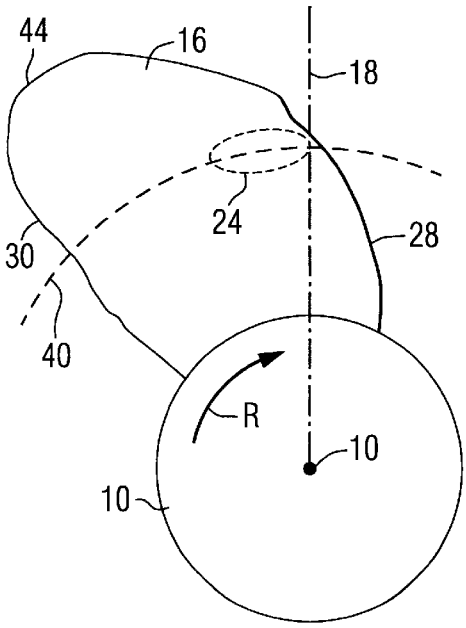
FIG. 3 PRIOR ART
FIGS. 3 and 4 show a known blade and the present invention, respectively.

With reference to FIG. 3, which is a highly simplified reproduction of FIG. 1, it can be seen that the zone 24 of pressure centers is located behind the spindle axis 18, with respect to the direction of rotation of the hub structure 10 as represented by arrow R. As a result, a spindle moment exists about the spindle axis 18 which is in a direction that tends to move the first blade 16 toward a position of minimum pitch. Because of the relative positions of the spindle axis 18 and the zone 24, this spindle moment will tend to move the blade 16 toward this position of lesser pitch and, if an actuator fails, the first blade 16 will naturally move in that direction as a result of hydrodynamic forces.

Figure 4:
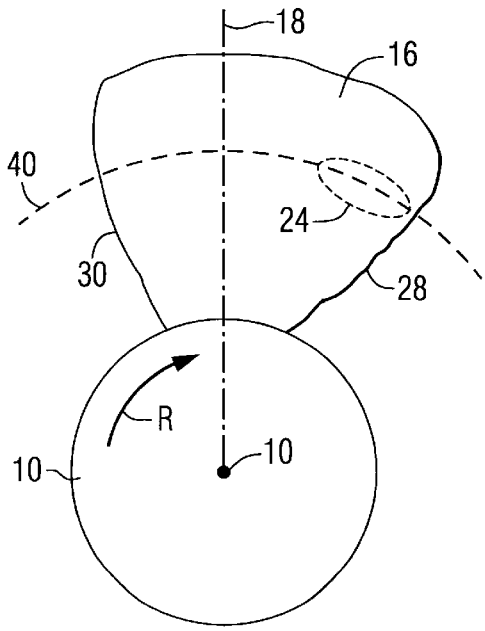

With reference to FIG. 4, the present invention results in the zone 24 of pressure centers being in front of the spindle axis 18, with respect to the direction of rotation R. This results from the forward skewing of the first blade 16. If the actuation system of the controllable pitch propeller fails, the hydrodynamic forces will therefore exert a spindle moment about the spindle axis 18 that tends to move the blade 16 toward a position of maximum pitch.

With reference to FIGS. 3 and 4, it can be seen that the present invention shifts the relative positions of the spindle axis 18 and the zone 24 of pressure centers. In the prior art propeller of FIG. 3, the zone 24 trails the spindle axis 18 with respect to the direction of rotation R. In the present invention, shown in FIG. 4, the spindle axis 18 trails the zone 24 of pressure centers with respect to the direction of rotation R. If an actuator failure occurs, either mechanically or hydraulically, the prior art blade of FIG. 3 will move toward a position of minimum pitch while the blade of the present invention, shown in FIG. 4, will move to a position of increased pitch. By moving toward the position of maximum pitch, the present invention allows the marine vessel operator to navigate a course toward home port or toward a location where repairs can be accomplished. The advantage of the present invention is achieved through the forward skewing of the blade 16 relative to the spindle axis 18.

Figure 5:
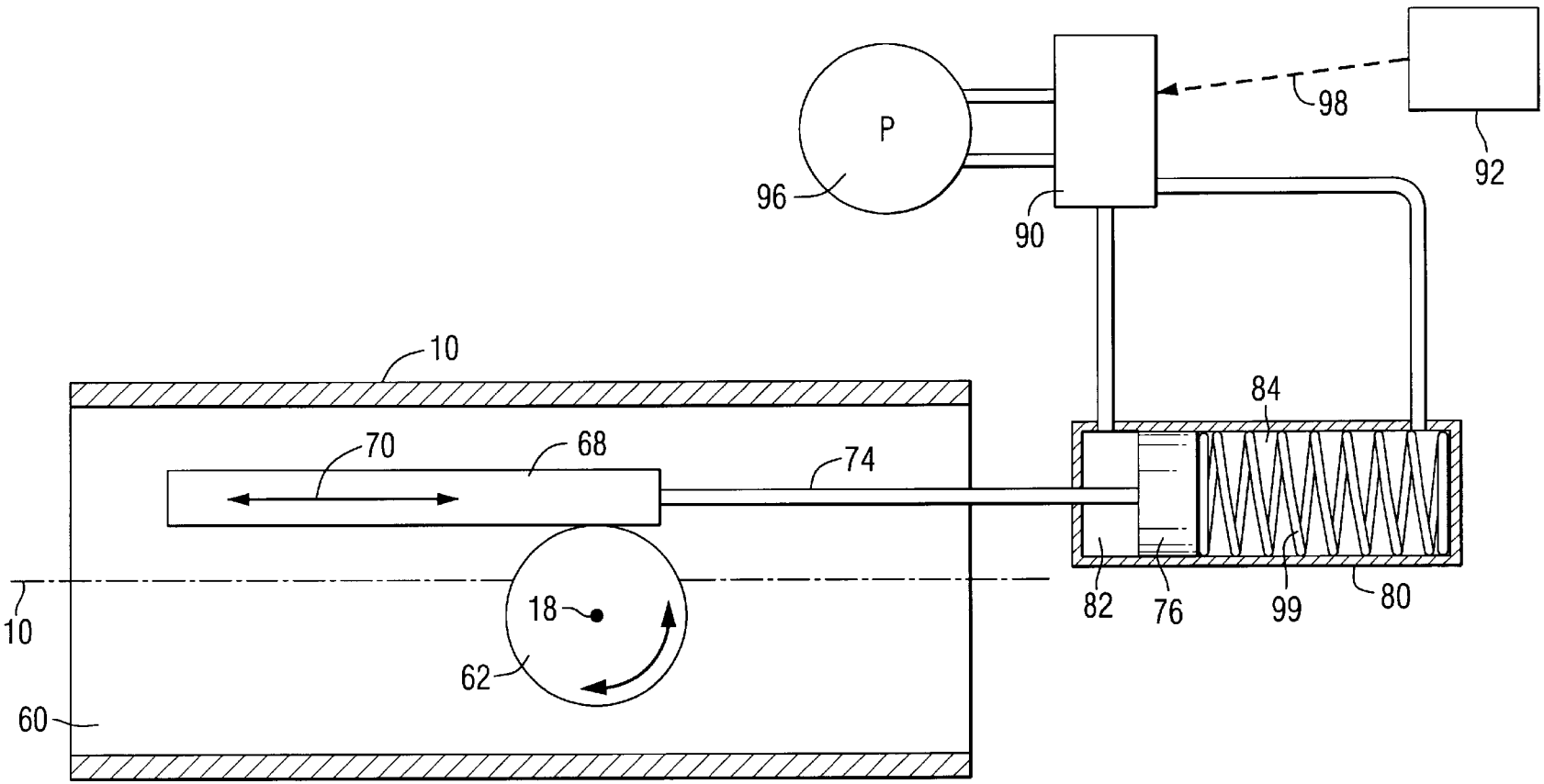
FIG. 5 is a highly schematic representation of a pitch control system using a hydraulic cylinder.

FIG. 5 is a highly simplified schematic representation of the internal structure of an exemplary propeller, including an actuator comprising a rack and pinion structure, made in accordance with the present invention. The hub structure 10 has a central portion 60 in which a base 62 of a propeller blade is shown. The base 62 is attached to a blade 16 for rotation about a spindle axis 18. Although the spindle axis 18 in FIG. 5 is not shown as being perpendicular to the axis 10 of rotation of a propeller shaft and of the hub structure 10, it should be understood that a typical application of a controllable pitch propeller could typically have the spindle axis 18 being perpendicular to the axis 10 of the hub structure 10.

With continued reference to FIG. 5, a rack and pinion structure is schematically represented by the relationship between the base 62 and a rack 68 which is reciprocally movable, as represented by arrow 70, in a direction generally parallel to the axis 10. A shaft 74 is attached to the rack 68 and is also attached to a piston 76 disposed within a cylinder 80. The piston 76 is movable within the cylinder 80 in response to changes in pressure between a first region 82 and second region 84 within the cylinder 80. A hydraulic fluid is caused to flow into and out of these two regions, 82 and 84, in response to a valve 90 that is controlled by a controller 92. The valve 90 is associated with a pump 96. The controller 92 can be an engine control unit (ECU) or any microprocessor-base component capable of providing signals, on line 98, to the valve 90. The valve can also be operated by a mechanical or electromechanical device. In the example shown in FIG. 5, a spring 99 is used to urge the piston 76 toward a preferred position within the cylinder 80. This preferred position can be a position that corresponds to a maximum pitch position of the blade 16 which is attached to the base 62. In other words, the spring 99 acts to move the piston 76 in a direction toward maximum pitch for the blade which is connected to the base 62. This action by the spring 99 is in addition to the hydrodynamic forces described above which also tend to rotate the blade about the spindle axis 18 in a direction toward maximum pitch. Although the spring 99 serves a useful purpose in this way, it should be understood that it is not required in all applications of the present invention. Instead, the hydrodynamic forces described above can be sufficient to achieve the desired results of increased pitch in the event of a hydraulic failure.

With continued reference to FIG. 5, it can be seen that a hydraulic failure, either with the pump 96, the valve 90, or any of the hydraulic fluid lines, could leave the marine vessel without any controlled means to adjust the pitch angle of the blades of the propeller. The present invention, through its natural use of hydrodynamic forces, achieves a pitch position of the blades which allows the operator of the marine vessel to navigate toward a port where repairs can be completed.

Although not specifically shown in FIG. 5, other forms of mechanical assistance, in addition to the spring 99, which compliment the present invention. Mechanical limits can be placed in the system which limit the travel of the blades in the direction toward maximum pitch in the event of a mechanical or hydraulic failure. This would stop the movement of the blades at a preselected increased pitch position that is less than the maximum possible pitch position of the blades.

Although the embodiment shown in FIG. 5 is hydraulic in nature, it should be understood that totally mechanical systems can also be used in conjunction with controllable pitch propellers. Furthermore, electrical motors can be used. In any type of controllable pitch propeller application, the blade design of the present invention will be useful in the event of a failure of the system.

Figure 6:
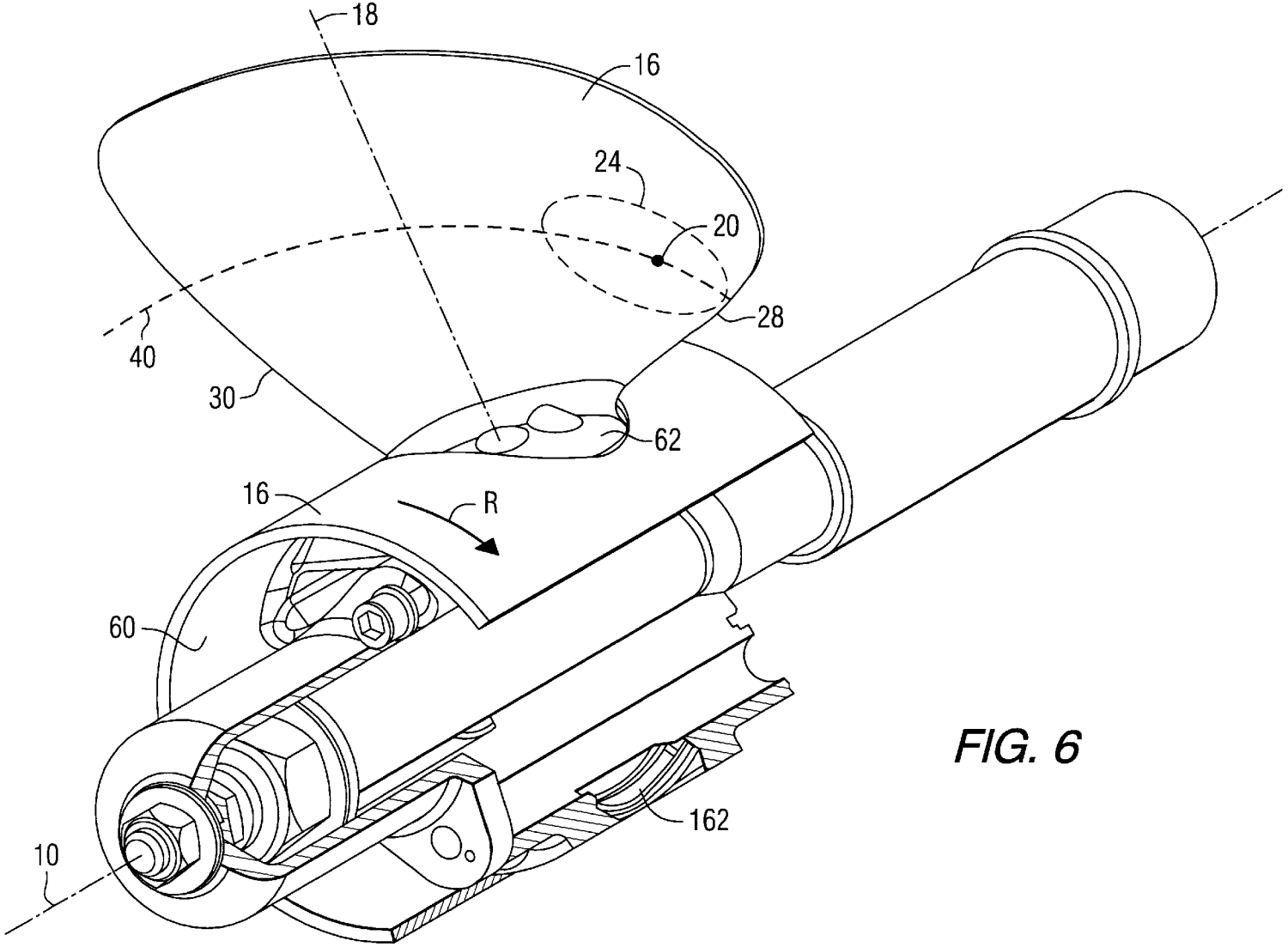
FIG. 6 is a view of a propeller hub and a blade attached to a propeller shaft.

FIGS. 6 shows a propeller hub 10 in section view. Also shown in FIG. 6 is an opening 162 where the base 62 of another blade 16 can be supported for rotation about its own spindle axis 18. The central portion 60 of the hub structure 10 contains the mechanism that causes the base 62 of each of the blades 16 to rotate about its respective spindle axis 18. The actuator within the central portion 60 of the hub 10 can be mechanical, hydraulic, or electrical. In response to a controller 92 (not shown in FIG. 6) which provides signals to command the movement of the blades to the desired pitch position, the actuator causes the physical rotation of the base 62 of each blade 16 to achieve the commanded pitch position.

In certain embodiments of the present invention, the spindle axis 18 is generally perpendicular to the axis of rotation 10 and intersects the axis 10. However, this is not a requirement for all embodiments of the present invention.

As can be seen in FIG. 6, hydrodynamic forces acting on the center of pressure 20, within the zone 24 of pressure sensors, will cause the blade 16 to rotate about the spindle axis 18 in a direction that will increase its pitch. Therefore, if a failure occurs in the actuation system of the controllable pitch propeller, the propeller will remain operative and allow the vessel operator to return to port.

Although the present invention has been described with particular specificity and illustrated to show one particularly preferred embodiment, it should be understood that other embodiments were also within its scope.

We claim:

1. A controllable pitch marine propeller, comprising:

a hub structure attachable to a propeller shaft of a marine propulsion system of a marine vessel for rotation about an axis of said propeller shaft;

a first blade rotatably attached to said hub structure for rotation about a spindle axis, said first blade having a surface which is shaped to create a force having a component generally parallel to said axis of said propeller shaft in response to rotation of said hub structure with said first blade at least partially submerged in water, said first blade being rotatable about said spindle axis, said surface of said first blade having an effective center of pressure located within a zone of pressure centers and at an instantaneous position within said zone of pressure centers determined as a function of both a speed of said marine vessel and a rotational speed of said hub structure about said axis of said propeller shaft, said force having a magnitude determined as a function of both said speed of said marine vessel and said rotational speed of said hub structure about said axis of said propeller shaft, said force acting on said surface of said first blade at said instantaneous position of said center of pressure within said zone of pressure centers, said first blade being shaped to result in said zone of pressure centers being ahead of said spindle axis relative to the direction of rotation of said hub structure under at least a majority of magnitudes of said speed of said marine vessel and said rotational speed of said hub structure about said axis of said propeller shaft under which said propeller is operated;

a controller for selecting a desired pitch of said first blade;

an actuator disposed within said hub structure to cause said first blade to rotate about said spindle axis in response to control signals from said controller selected to achieve said desired pitch of said first blade; and whereby said first blade is moved toward a position of higher pitch in response to hydrodynamic forces on said surface of said first blade, under at least said majority of operating conditions, in the event that said actuator is rendered ineffective to control said pitch of said first blade.

2. The propeller of claim 1, further comprising:

a second blade shaped, disposed and configured similarly to said first blade.

3. The propeller of claim 1, wherein:

said first blade being shaped to result in said spindle axis being ahead of said zone of pressure centers relative to the direction of rotation of said hub structure under all operating conditions.

4. The propeller of claim 1, further comprising:

a hydraulic system comprising at least one piston disposed in a cylinder for moving said actuator.

5. The propeller of claim 1, further comprising:

a mechanical device connected in force transmitting association with said actuator for urging said first blade toward a position of higher pitch independently of any hydrodynamic forces on said surface of said first blade.

6. The propeller of claim 1, wherein:

said instantaneous position within said zone of pressure centers being determined as a direct function of said speed of said marine vessel and as an inverse function of said rotational speed of said hub structure about said axis of said propeller shaft.

7. The propeller of claim 1, wherein:

said force has a magnitude determined as an inverse function of said speed of said marine vessel and as a direct function of the square of said rotational speed of said hub structure about said axis of said propeller shaft.

8. The propeller of claim 1, wherein:

said actuator comprises a rack and a pinion.

9. The propeller of claim 1, wherein:

said first blade being shaped to result in said spindle axis being ahead of said zone of pressure centers relative to the direction of rotation of said hub structure when said hub structure is rotating in a direction to cause said force to propel said marine vessel to move in a forward direction.

10. The propeller of claim 1, wherein:

said first blade being shaped to result in said spindle axis being ahead of said zone of pressure centers relative to the direction of rotation of said hub structure when said hub structure is rotating in a direction to cause said force to propel said marine vessel to move in a reverse direction.

11. A controllable pitch marine propeller, comprising:

a hub structure attachable to a propeller shaft of a marine propulsion system of a marine vessel for rotation about an axis of said propeller shaft;

a first blade rotatably attached to said hub structure for rotation about a spindle axis, said first blade having a surface which is shaped to create a force having a component generally parallel to said axis of said propeller shaft in response to rotation of said hub structure with said first blade at least partially submerged in water, said first blade being rotatable about said spindle axis, said surface of said first blade having an effective center of pressure located within a zone of pressure centers and at an instantaneous position within said zone of pressure centers determined as a function of both a speed of said marine vessel and a rotational speed of said hub structure about said axis of said propeller shaft, said force having a magnitude determined as a function of both said speed of said marine vessel and said rotational speed of said hub structure about said axis of said propeller shaft, said force acting on said surface of said first blade at said instantaneous position of said center of pressure within said zone of pressure centers, said first blade being shaped to result in said zone of pressure centers being ahead of said spindle axis relative to the direction of rotation of said hub structure under at least a majority of magnitudes of said speed of said marine vessel and said rotational speed of said hub structure about said axis of said propeller shaft under which said propeller is operated;

a controller for selecting a desired pitch of said first blade;

an actuator disposed within said hub structure to cause said first blade to rotate about said spindle axis in response to control signals from said controller selected to achieve said desired pitch of said first blade;

whereby said first blade is moved toward a position of higher pitch in response to hydrodynamic forces on said surface of said first blade, under at least said majority of operating conditions, in the event that said actuator is rendered ineffective to control said pitch of said first blade;

a second blade shaped, disposed and configured similarly to said first blade; and a hydraulic system comprising at least one piston disposed in a cylinder for moving said actuator.

12. The propeller of claim 11, wherein:

said first and second blades each being shaped to result in said spindle axis being ahead of said zone of pressure centers relative to the direction of rotation of said hub structure under all operating conditions.

13. The propeller of claim 12, further comprising:

a mechanical device connected in force transmitting association with said actuator for urging said first blade toward a position of higher pitch independently of any hydrodynamic forces on said surface of said first blade.

14. The propeller of claim 13, wherein:

said instantaneous position within said zone of pressure centers being determined as a direct function of said speed of said marine vessel and as an inverse function of said rotational speed of said hub structure about said axis of said propeller shaft.

15. The propeller of claim 14, wherein:

said force has a magnitude determined as an inverse function of said speed of said marine vessel and as a direct function of the square of said rotational speed of said hub structure about said axis of said propeller shaft.

16. The propeller of claim 15, wherein:

said actuator comprises a rack and a pinion.

17. The propeller of claim 16, wherein:

said first blade being shaped to result in said spindle axis being ahead of said zone of pressure centers relative to the direction of rotation of said hub structure when said hub structure is rotating in a direction to cause said force to propel said marine vessel to move in a forward direction.

18. The propeller of claim 16, wherein:

said first blade being shaped to result in said spindle axis being ahead of said zone of pressure centers relative to the direction of rotation of said hub structure when said hub structure is rotating in a direction to cause said force to propel said marine vessel to move in a reverse direction.

19. A controllable pitch marine propeller, comprising:

a hub structure attachable to a propeller shaft of a marine propulsion system of a marine vessel for rotation about an axis of said propeller shaft;

a first blade rotatably attached to said hub structure for rotation about a spindle axis, said first blade having a surface which is shaped to create a force having a component generally parallel to said axis of said propeller shaft in response to rotation of said hub structure with said first blade at least partially submerged in water, said first blade being rotatable about said spindle axis, said surface of said first blade having an effective center of pressure located within a zone of pressure centers and at an instantaneous position within said zone of pressure centers determined as a function of both a speed of said marine vessel and a rotational speed of said hub structure about said axis of said propeller shaft, said force having a magnitude determined as a function of both said speed of said marine vessel and said rotational speed of said hub structure about said axis of said propeller shaft, said force acting on said surface of said first blade at said instantaneous position of said center of pressure within said zone of pressure centers, said first blade being shaped to result in said zone of pressure centers being ahead of said spindle axis relative to the direction of rotation of said hub structure under at least a majority of magnitudes of said speed of said marine vessel and said rotational speed of said hub structure about said axis of said propeller shaft under which said propeller is operated;

a controller for selecting a desired pitch of said first blade;

an actuator disposed within said hub structure to cause said first blade to rotate about said spindle axis in response to control signals from said controller selected to achieve said desired pitch of said first blade;

whereby said first blade is moved toward a position of higher pitch in response to hydrodynamic forces on said surface of said first blade, under at least said majority of operating conditions, in the event that said actuator is rendered ineffective to control said pitch of said first blade;

a second blade shaped, disposed and configured similarly to said first blade;

a hydraulic system comprising at least one piston disposed in a cylinder for moving said actuator, said first and second blades each being shaped to result in said spindle axis being ahead of said zone of pressure centers relative to the direction of rotation of said hub structure under all operating conditions;

a mechanical device connected in force transmitting association with said actuator for urging said first blade toward a position of higher pitch independently of any hydrodynamic forces on said surface of said first blade.

20. The propeller of claim 19, wherein:

said force has a magnitude determined as an inverse function of said speed of said marine vessel and as a direct function of the square of said rotational speed of said hub structure about said axis of said propeller shaft, said instantaneous position within said zone of pressure centers being determined as a direct function of said speed of said marine vessel and as an inverse function of said rotational speed of said hub structure about said axis of said propeller shaft, said first and second blades each being shaped to result in said spindle axis being ahead of said zone of pressure centers relative to the direction of rotation of said hub structure when said hub structure is rotating in a direction to cause said force to propel said marine vessel to move in a forward direction, said first and second blades each being shaped to result in said spindle axis being ahead of said zone of pressure centers relative to the direction of rotation of said hub structure when said hub structure is rotating in a direction to cause said force to propel said marine vessel to move in a reverse direction.

* * * * *